United States Patent [19]

Oesterle

[11] 4,074,843

[45] Feb. 21, 1978

[54] FASTENING ELEMENT FEEDING DEVICE FOR AN EXPLOSIVE POWDER DRIVEN SETTING GUN

[75] Inventor: Helmut Oesterle, Nofels, Austria

[73] Assignee: Hilti Aktiengesellschaft, Schaan, Liechtenstein

[21] Appl. No.: 752,096

[22] Filed: Dec. 20, 1976

[30] Foreign Application Priority Data

Dec. 22, 1975 Germany ..... 2557847

[51] Int. Cl.[2] ..... B25C 1/14

[52] U.S. Cl. ..... 227/8; 227/10

[58] Field of Search ..... 227/8, 9, 10, 107

[56] References Cited

U.S. PATENT DOCUMENTS

| | | | |
|---|---|---|---|
| 2,876,931 | 3/1959 | Marsh | 227/9 |
| 3,029,978 | 4/1962 | Gummere et al. | 227/9 |
| 3,891,133 | 6/1975 | Maier et al. | 227/10 |

*Primary Examiner*—Granville Y. Custer, Jr.

*Attorney, Agent, or Firm*—Toren, McGeady and Stanger

[57] ABSTRACT

To load fastening elements into the muzzle end of the barrel in an explosive powder driven setting gun, a tubular shaped feeding device is pivotally connected to the housing of the gun for movement between a first position where a fastening element can be inserted into the feeding device and a second position where the tubular shaped feeding device is aligned with the muzzle end of the barrel. An ejector is movably positioned in the feeding device for inserting a fastening element into the muzzle end of the barrel. The feeding device includes a member which prevents displacement of the barrel into the firing position when the feeding device is in the second position.

14 Claims, 4 Drawing Figures

FASTENING ELEMENT FEEDING DEVICE FOR AN EXPLOSIVE POWDER DRIVEN SETTING GUN

SUMMARY OF THE INVENTION

The present invention concerns an explosive powder driven setting gun for driving fastening elements, such as bolts, nails and the like, into a hard receiving material and, more particularly, it is directed to a feeding device pivotally mounted on the setting gun for inserting fastening elements into the muzzle end of the gun barrel.

In known setting guns, fastening elements, such as nails, must be inserted into the muzzle end of the gun barrel manually by the operator. The pointed end of the nails may cause finger injuries, particularly since clamping elements are provided for holding the nails in the barrel and such elements render the insertion of the nails more difficult. Further, many of these guns use a driving piston which must be returned to the rear end of the barrel after each fastening element setting operation, that is, the piston must be moved into the driving position. The displacement of the driving piston can be accomplished directly by pushing the piston into the firing position using the nail, or the piston can be moved using a rod member. Both of these operations is cumbersome and very time-consuming.

A substantial disadvantage of many setting guns which use single loading is that the nails must be equipped either with two guide discs or with one guide disc and a greatly increased head, for insuring that the nails are in a position parallel to the axis of the barrel. Such an arrangement requires a relatively elaborate design of the nail, which has a particularly negative effect on its cost, since nails are a mass-produced consumer article.

There are also known setting guns which use a nail magazine. Such a nail magazine can consist of a band-shaped carrier in which the nails are clamped in receiving bores extending perpendicularly to the plane of the band. The nails extend from one side of the carrier with their head and the adjoining shank portion located on the opposite side of the carrier. The magazine is guided or moved in a step-wise manner in a feeding device mounted on a gun casing and the device can be swung toward the muzzle end of the gun. When the feeding device is moved toward the muzzle, the head end of the nail is turned and introduced into the muzzle with the head displacing the driving piston as it is inserted. The nail propelled by the driving piston traverses the band-shaped carrier and cuts a disc-shaped portion out of the carrier with its head, normally the disc-shaped portion is perforated for ease in displacement. As the nail is driven into the receiving material, the disc-shaped portion is displaced into contact with the receiving material or with an object fastened to the material.

A general disadvantage experienced in the use of nail magazines is that the magazine is equipped with nails of the same size and, therefore, it is not possible to adapt the nail length to the conditions experienced, unless different magazines are used, which are difficult to handle.

Setting guns using such magazines only afford the insertion of relatively short nails, since, due to the pivotal movement of the magazine, the nail head would strike the muzzle next to the bore when the feeding device is moved.

Another problem is that the short nail with its head projecting from the carrier can displace the driving piston only a distance within the gun barrel and, as a result, the use of such devices are rather limited. Moreover, it is necessary to adapt the length of the driving piston exactly to the length of the nail being inserted into the barrel. Accordingly, the driving piston would not be displaced into its required rearmost position if the nail is too short. However, if the nail is too long though it would move the piston into its rearmost position it would do so before the feeding device has been moved completely into position and the inserted nail would not be placed in proper parallel position with the axis of the barrel.

In certain known setting guns using magazines, it is usually not possible to press the barrel against the receiving material before the gun is fired because of the presence of the nail feeding device. Such pressing of the barrel is usually required for safety reasons. Additionally, there is the risk that the feeding device and the setting gun itself will be destroyed due to inaccurate magazine feed and subsequent firing.

Therefore, the invention is directed to the problem of providing a setting gun which can be charged with individual fastening elements and which affords simplified safe handling.

In accordance with the present invention, this problem is solved by providing a feeding device including an ejector for displacing the fastening element from the device into the muzzle end of the barrel. Before the setting gun can be fired it is necessary to move the feeding device away from the muzzle and out of the path of a fastening element being driven by the gun.

Preferably, the feedind device consists of an axially elongated tubular member containing an ejector which is displacable in the axial direction of the tubular member. The ejector can be mounted within the tubular member or it can project into it. Such a feeding device can have individual fastening elements inserted into it before each loading operation of the setting gun and the type and length of the fastening element can be selected in accordance with the requirements of the receiving material.

To charge the feeding device with a fastening element it is moved away from the muzzle end of the barrel so that its open end is exposed. The fastening element is then introduced into the bore in the tubular member with the pointed end of the element being inserted first into the feeding device.

With the feeding device containing a fastening element, it is pivoted into axial alignment with the barrel. By using the ejector the fastening element can be pushed from the feeding device into the barrel of the setting gun. As the fastening element is inserted into the barrel it displaces the driving piston into the firing position. Depending on the requirements of the fastening operation, different types of lengths of fastening elements can be loaded into the barrel. Since an ejector is used for inserting the fastening elements into the barrel, the problems discussed above regarding finger injuries can be avoided.

It is advantageous to provide a latch for fixing the feeding device in position when it is displaced away from the muzzle of the setting gun.

One preferable arrangement of the ejector is as a plunger which is displaceable relative to the tubular member of the feeding device. If a plunger of sufficient length is used, good guidance of the plunger within the tubular member of the feeding device can be achieved. Furthermore, by using a plunger displaceable over a long path, the fastening element can be pushed sufficiently deeply into the barrel. To operate the plunger a handle can be provided projecting radially from the tubular member or the handle can be formed as an axially extending part of the tubular member protruding from one end. Instead of using a plunger, it is possible to use a latch extending radially into the bore within the feeding device.

To assure that the fastening element inserted into the feeding device does no drop out as the device is moved, a holding member for the fastening element can be provided within the device. Known mechanical clamping elements are suitable for this purpose, for example, a longitudinally slotted radial spring tube could be used.

Another type of holding member is a magnet. It is possible to insert a ring magnet within the bore of the tubular member. However, it is particularly advantageous if the plunger itself is formed as a magnet. In such an arrangement, the fastening element is not only secured against falling out accidentally, but it is also pulled toward the plunger by the magnet when it is inserted.

Another feature of the invention is the provision of a centering seat in the end of the plunger contacted by the pointed end of the fastening element. If has been found helpful to form the centering seat as a conically shaped blind bore. Such an arrangement ensures the parallel alignment of the fastening element with the axis of the barrel even if the element has only one guide disc, since the pointed end of the fastening element contacts the inclined wall of the centering seat when it is inserted into the barrel and is automatically aligned with the axis of the barrel.

The assure that the fastening element is maintained in parallel relation with the axis of the barrel after it is inserted, the barrel includes a holder for the fastening element. A longitudinally slotted spring tube is suitable as a holder. Such a holder ensures that the disc is engaged by the spring tube when the fastening element is inserted and the nail head is aligned centrally with the driving piston. The parallel relation of the fastening element with the axis of the barrel can be maintained by providing a central guide bore in the end of the piston. To assure that the fastening element remains in the barrel when the plunger is withdrawn, the clamping force of the holder is selected to be greater than the force of the holding means within the feeding device.

In setting guns where the barrel is axially displaceable into the firing position, it is preferable to provide a stop member which prevents the barrel from being displaced into its firing position when the feeding device is aligned in front of the muzzle of the barrel. Such a construction positively prevents any ignition as the fastening element is inserted into the barrel even if the element becomes stuck in the barrel during insertion because of some adverse circumstances or if a propellant charge is, for some reason, introduced into the firing chamber.

The stop for the barrel can be in the form of a two-arm lever with one arm positionable in the path of the feeding device when the device is moved in front of the barrel and with the other arm arranged in locking contact with the barrel. It is advisable to include a spring which urges the lever toward the barrel. With this arrangement the barrel is blocked from the firing position by one arm of the lever as the feeding device is moved into position in front of the barrel. It has been found to be particularly advantageous to use a gripping arm actuated by the feeding device as the stop member. The gripping arm can be pivotally mounted on the feeding device a short distance from the pivotal point of the device so that the arm is displaced in its longitudinal direction as the feeding device is moved from one position to another. When the feeding device is moved toward the muzzle, the gripping arm moves the barrel forwardly and prevents it from returning to the firing position as a fastening element is inserted into the barrel.

Preferably, the barrel has a shoulder engageable by the gripping arm. The shoulder can be formed as a circumferential groove.

Another feature of the invention is the provision of a feed lever interconnected to the feeding device and arranged to provide the step-wise advance of a magazine containing cartridges or propellant charges. Such a construction considerably simplifies the handling of the setting gun and insures that a cartridge or charge is brought into alignment with the firing chamber after a fastening element has been fed into the barrel. It has been found advantageous to utilize a known magazine clip which retains the cartridge even after the firing action. As a result, the cartridges or propellent charges are fed to the gun and, if cartridges are used, the empty cases are removed out of the firing position after each firing step. In accordance with known practice, the sides of the magazine are provided with recesses, such as notches, which can be engaged by the feed lever for effecting the movement of the magazine.

The feed lever can be constructed as a two-arm pawl. One arm engages the magazine, while the other arm extends into the path of movement of the feeding device as it is moved into position in front of the muzzle. A spring acts on the pawl urging the one arm toward the magazine and the other arm into the path movement of the feeding device. Accordingly, the one arm is automatically engaged in the recesses in the magazine as soon as the feeding device begins to move toward the muzzle. Torsion springs, coil springs and the like are suitable for use as the spring which acts on the pawl.

It is preferable, however, if the feed lever is constructed as a swivel arm having its fulcrum mounted on the gun housing. The swivel or pivotal movement of the lever can be controlled by a linkage in engagement with a cam secured on the gripping arm.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
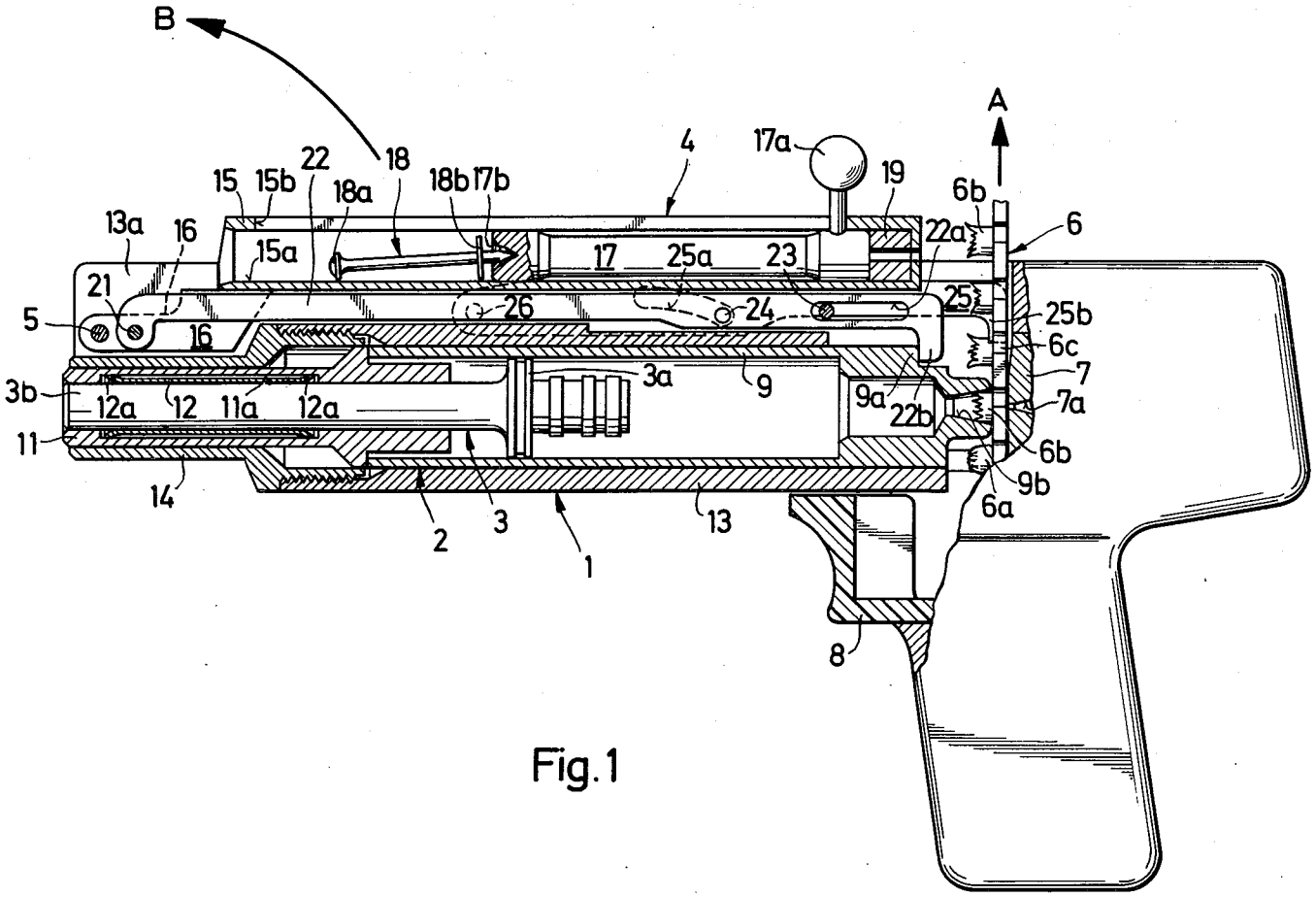
FIG. 1 is a side view, partly in section, of a fastening element setting gun showing the gun in its condition following insertion of a fastening element with the barrel pressed against the receiving material, and with the feeding device in the charging position with a fastening element inserted.

In the drawings, a setting gun is illustrated consisting of a casing 1, a barrel 2 axially displaceably mounted in the casing, and a driving piston 3 axially displaceable within the barrel. Pivotally mounted on the casing, adjacent the muzzle end of the barrel, is a feeding device 4 which pivots about a pin or axle 5. At the rearward end of the barrel, a magazine 6 traverses the casing for supplying propellent charges or cartridges to the firing chamber. As shown, cartridges are supported in the magazine and include live cartridges **6*a* and expended cartridges 6*b* which remain in the magazine after firing. On its opposite side from the barrel, the magazine bears on a breech ring 7 which contains a bore 7*a* containing a firing pin. The firing pin is part of a known firing mechanism and, accordingly, is not illustrated. Further, the firing mechanism is actuated by a trigger 8**.

The barrel 2 is formed of a rear guide tube 9, in which the enlarged head end **3*a* of the driving piston 3 is displaceably mounted, and a muzzle tube 11 which is displaceable relative to the guide tube 9 for assembly purposes. Shank end 3*b* of the driving piston 3 extends forwardly from its head end 3*a* and is guided within the muzzle tube 11. Further, the muzzle tube also acts as a guide fo fastening elements inserted into the tube. Seated within the bore of the muzzle tube is a holder in the form of a tubular longitudinally slotted spring 12 for gripping or clamping a fastening element. The opposite ends 12*a* of the spring are bent outwardly in the manner of skids for facilitating, on one hand, the introduction of a fastening element into the muzzle tube and, on the other hand, to permit forward movement of the shank 3*b* toward the muzzle end of the barrel. The interior of the muzzle tube has a circular groove 11*a* in which the holder spring 12** is seated and the axially spaced ends of the groove serve as stops for the spring.

Casing 1 is made up of a body 13 and a front cap 14 threaded onto the body at the muzzle end of the gun. The axle 5 for the feeding device is supported in fins **13*a* projecting laterally outwardly from the body 13. Feeding device 4 includes an axially elongated tubular member 15 open at one end and having supporting legs 16 extending from the open end and mounted on the axle 5. Mounted within a fastening element receiving bore 15*a* in the tubular member 15 is a plunger 17. The plunger 17 is axially displaceable through the bore 15*a*. Axial displacement of the plunger is effected by a handle 17*a* secured to and extending laterally outwardly through a slot 15*b* extending in the axial direction of the tubular member 15. The axial movement of the plunger is limited by the opposite ends of the slot 15*b*. The end of the plunger 17 facing toward the open end of the bore 15*a* has a conically shaped centering seat 17*b* which is arranged to receive the pointed end of a nail inserted into the bore 15. As can be noted, in its inserted position, the nail 18 is inclined within the bore and its pointed end is held in the seat 17*b*. The holding action can be effected by forming the plunger as a magnet. Another possibility is to provide a ring magnet within the bore of the tubular member. Further, various mechanical clamping elements could also be used for holding the fastening element within the bore. However, it is particularly advantageous if the plunger itself is a magnet for securing the fastening element against accidental displacement from the tubular member. In addition, plunger 17 is secured in its rearward position, that is the position shown in FIG. 1, by a magnet 19 secured within the closed end of the tubular member 15**.

Figure 2:
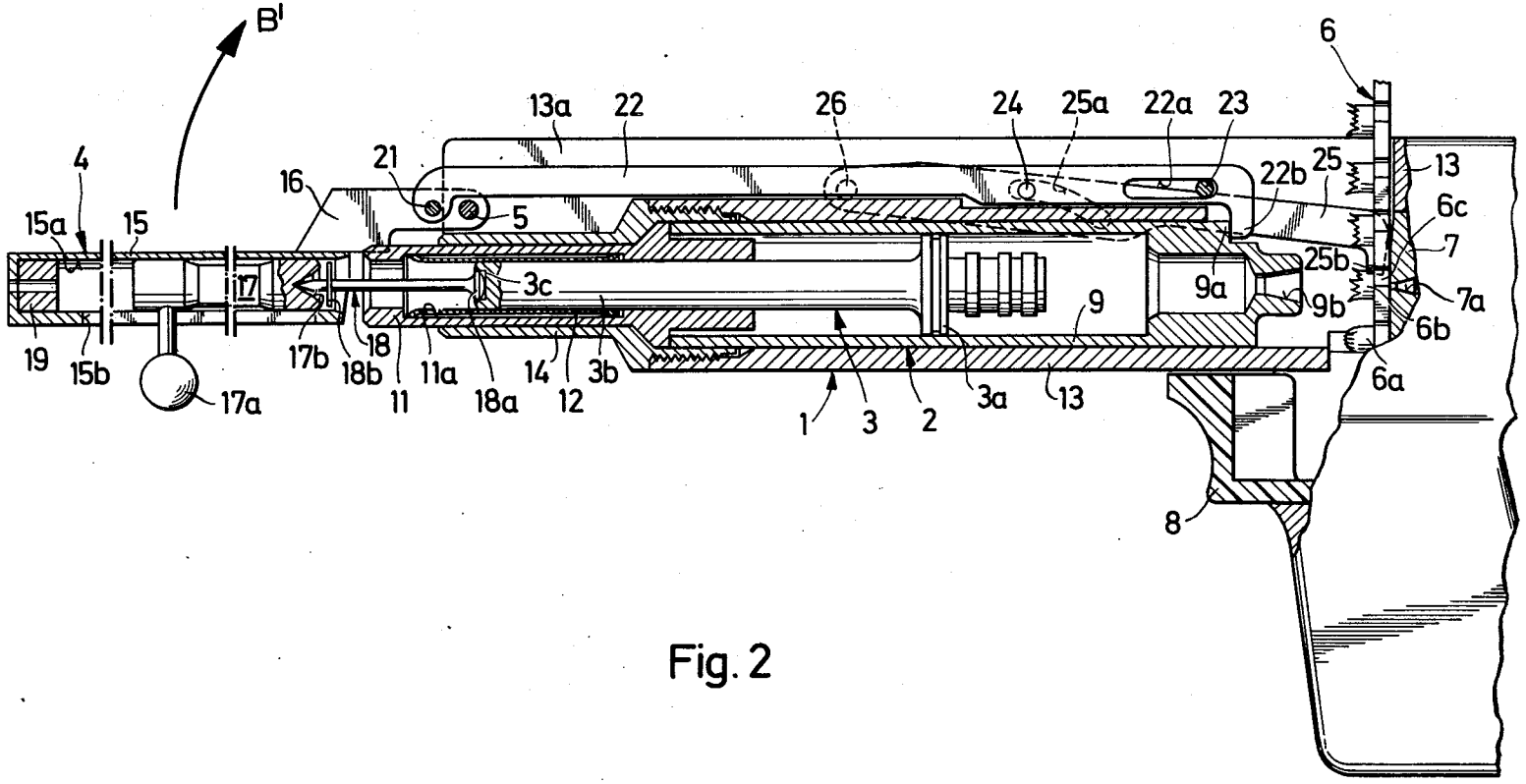
FIG. 2 is view similar to FIG. 1, however, the feeding device is pivoted into position in front of the muzzle end of the setting gun barrel and it illustrates the movement of a fastening element from the feeding device into the barrel.
Figure 3:
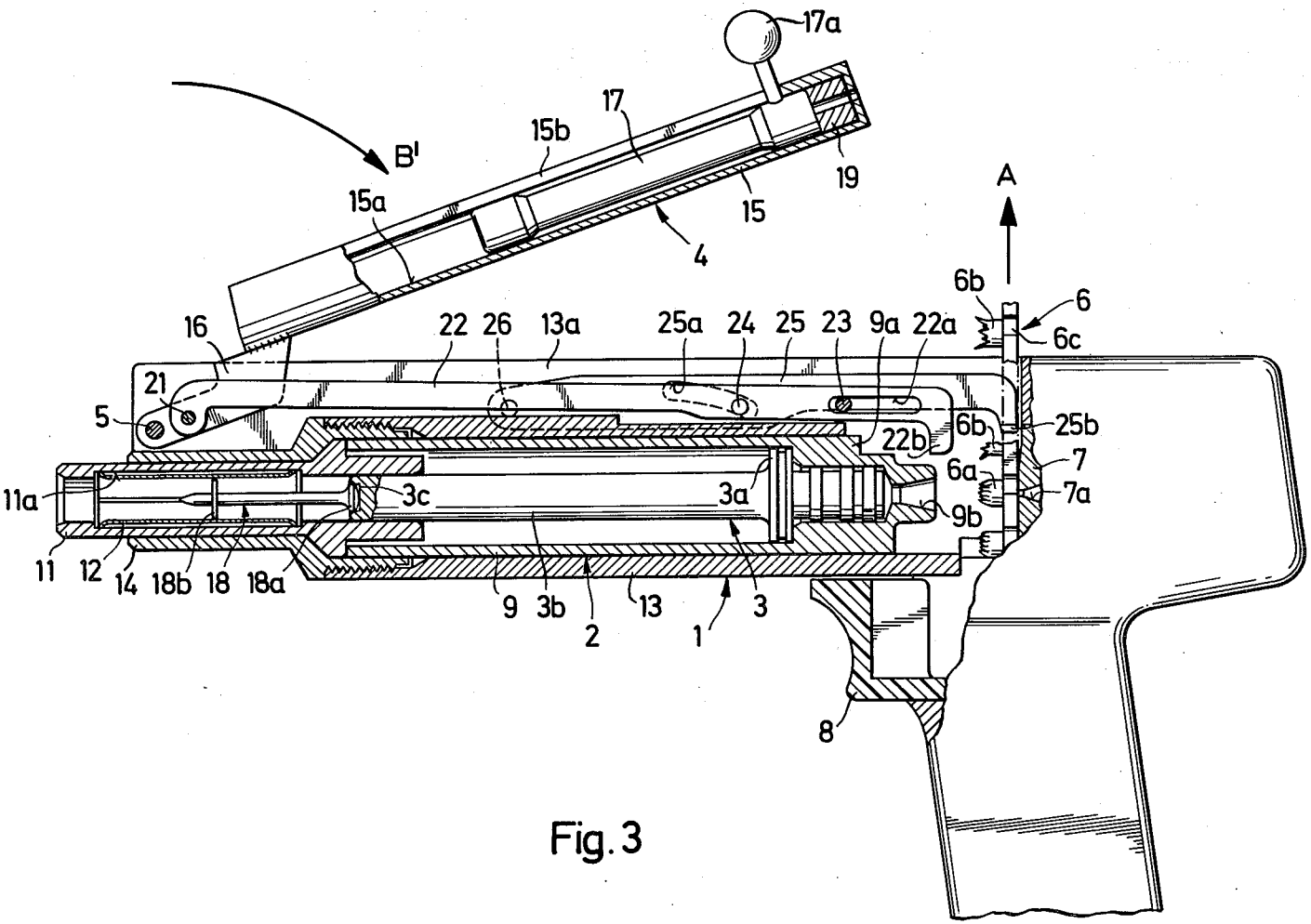
FIG. 3 is a view similar to FIG. 1 but with the fastening element fully introduced into the barrel and the feeding device pivoted from the muzzle toward the charging position of the FIG. 1.

Positioned in the supporting leg 16 and spaced from the axle 5 is a pin or journal 21 mounting one end of a gripping arm 22. At its opposite end, the gripping arm has an oblong slot **22*a* and a pin 23 secured to the body 13 extends into the slot so that the arm can be displaced in the axial direction of the gun barrel over the length of the slot. At the rearward end of the gripping arm, that is the end opposite its connection to the supporting leg, a lateral projection 22*b* extends downwardly behind a shoulder 9*a* on the rearward end of the barrel 2. As can be seen in FIGS. 1–3, a pin 24 is secured to and extends laterally from the gripping arm 22 and is disposed in engagement with a curved cam slot 25*a* in feed lever 25. The pin 24 and the cam slot 25*a* are located adjacent the rearward end of the gripping arm 22 and the feed lever 25, respectively. The forward end of the feed lever 25 located at an intermediate point along the gun housing is connected by a bearing pin 26 to the body 13. By virtue of the engagement of the pin 24 in the cam slot 25*a*, the feed lever 25 is pivoted about pin 26 when the gripping arm 22 is displaced by movement of the feeding device 4. The rearward end of the feed lever 25, that is the opposite end from the one mounted on the bearing pin, is shaped as a gripper 25*b* for moving magazine 6 is a step-wise manner in the direction of the arrow A, note FIGS. 1 and 3. The gripper 25*b* engages notches 6*c*** in the sides or edges of the magazine for effecting its displacement.

In FIG. 1, driving piston 3 is in the forward position assumed after a fastening element has been driven into a receiving material. Barrel 2 is still in the rear position and the cartridge **6*b* just expended in inserting the fastening element is still in the cartridge or firing chamber 9*b* at the rearward end of the barrel. Feeding device 4 in the charging position on top of the gun housing and the gripping arm 22 is in its rearward position in contact with the shoulder 9*a* on the barrel. Further, pin 24 has moved the feed lever 25** into the top position.

In FIG. 2 the feeding device 4 has been pivoted from the position shown in FIG. 1 about axle 5 in the direction of the arrow B in FIG. 1 until the tubular member 15 of the device is aligned with the barrel 2. In the position shown in FIG. 2, the bore **15*a* of the tubular member 15 forms an extension of the barrel 2. During the pivotal movement of the feeding device 4, journal 21 has been moved through 180° about axle 5 so that the gripping arm 22 has been displaced forwardly, that is, in the direction toward the muzzle end of the gun. It can be noted in FIG. 1 that the journal 21 lies on the right-hand side of the axle 5 while in FIG. 2 it lies on the left-hand side of the axle. Due to the engagement of the lateral projection 22*b* on the rearward end of the gripping arm 22 with the shoulder 9*a* on the barrel 2, the barrel has been moved forwardly as a consequence of the forward movement of the gripping arm and the rearward end of the barrel has been spaced from the magazine containing the cartridges. The engagement of the lateral projection 22b with the shoulder 9a prevents the barrel from being displaced rearwardly into the firing position. When the barrel is displaced in the forward direction, the previously fired cartridge 6b is removed from the cartridge chamber 9b due to the forward movement of the chamber. Moreover, the gripping arm 22 has moved the pin 24 forwardly through the curved cam slot 25a causing the feed lever 25 to pivot in the clockwise direction about its bearing pin 26. This downward movement of the feed lever moves the gripper 25b at its rearward end under the next notch 6c** in the magazine.

As shown in FIG. 2, the plunger 17 has been moved opposite to the firing direction and the fastening member 18 has been displaced into the barrel 2 into contact with the forward end of the driving piston 3. Accordingly, the pointed end of the fastening element is pressed into the center of the centering seat 17b in the end of the plunger and the element due to the cooperating action of the disc 18b assumes a position in parallel with the axis of the barrel. To maintain the parallel position of the fastening element within the muzzle tube, the forward end of the shank 3b has a countersunk recess 3c. With the continued displacement of the plunger toward and into the barrel 2, the fastening element is pushed into the barrel and the driving piston, in turn, is moved rearwardly until it strikes against the rearward end of the guide tube 9. With the insertion of the fastening element completed, the plunger is withdrawn back into the tubular member 15 until it contacts the magnet 19. The fastening element 18 is held within the muzzle tube 11 by virtue of the gripping action provided by the holder 12 on the disc 18b of the element.

With the fastening element inserted into the barrel and the plunger fully withdrawn back into the tubular member 15, the feeding device is pivoted in the direction of the arrows B', note FIGS. 2 and 3 toward the position of the device shown in FIG. 1. During this return movement of the device, the connection provided by the journal 21 moves the gripping arm 22 in the rearward direction permitting the barrel to be returned into the firing position. Moreover, by the rearward displacement of the gripping arm 22, feed lever 25 is again turned in the counter-clockwise direction, as shown in FIG. 3, and the gripper 25b at the rear end of the lever moves the magazine by one step in the direction of the arrow A. In FIG. 3 the return of the feeding device to its charging position has been almost completed. Due to the movement of the magazine, a live cartridge 6a has been positioned in alignment with the cartridge chamber 9b in the rearward end of the barrel. Because of the corresponding curvature of the cam slot 25a an accurate sliding feed of the magazine is insured.

Figure 4:
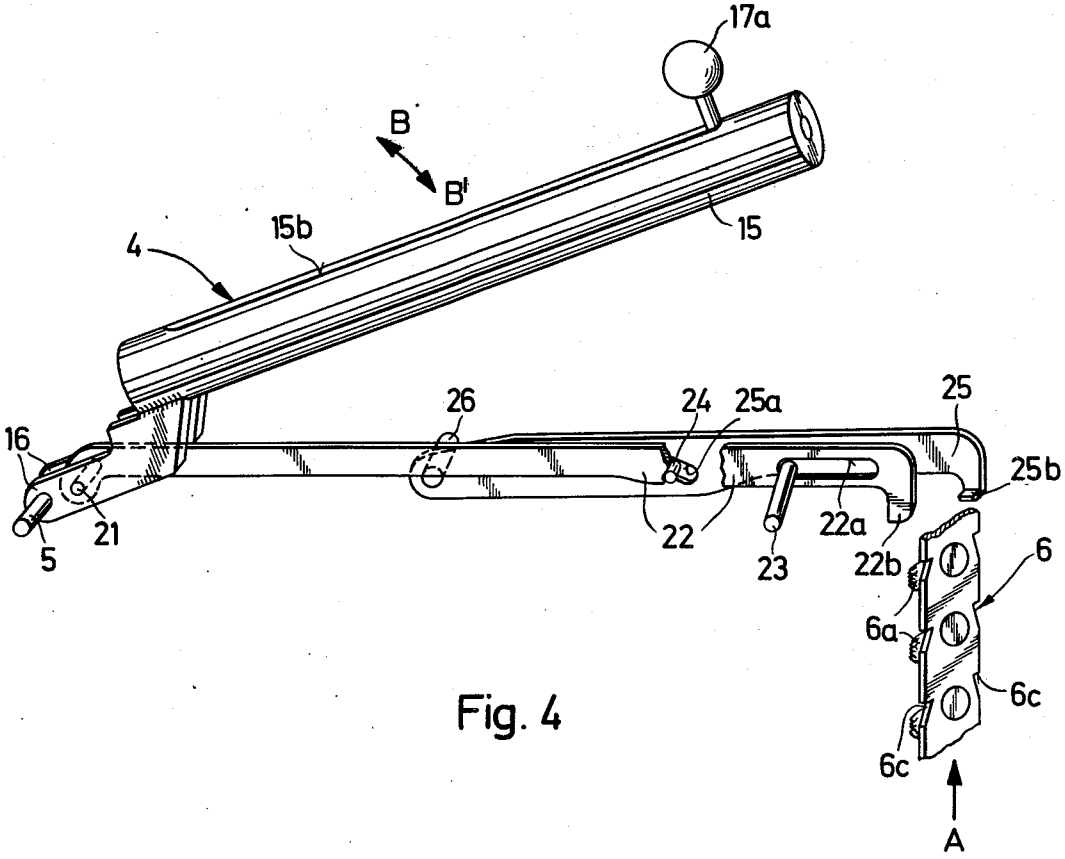
FIG. 4 is a perspective view of the feeding device along with the device for blocking movement of the barrel into the firing position, and of the feed lever for the magazine with these various parts being shown in the position according to that illustrated in FIG. 3.

In FIG. 4 the interaction between the feeding device 4, the gripping arm 22 and the feed lever with the magazine 6, is illustrated. The axle 5, the bearing pin 26 and the pin 23 secured on the gun housing are represented in FIG. 4 as projecting parts. The figure shows, in particular, the two-sided or-part supporting leg 16 connected to the forward or open end of the tubular member 15 of the feeding device 4. The figure also shows the support of gripping arm 22 by means of the journal 21 mounted in the opposite sides of parts of the supporting leg, and also the longitudinal or axial guidance of the gripping arm by means of the interengagement of the pin 23 within the slot 22a. The downwardly extending nose or lateral projection 22b on the end of the gripping arm is also clearly shown. During the movement of the feeding device, feed lever 25 pivots about bearing pin 26 guided by the interengagement of pin 24 within cam slot 25a, the pin 24 being secured to the gripping arm. The gripper 25b at the rearward end of the feed lever 25 can be clearly seen. The gripper can be resilient in itself to permit lateral yielding and gripping action with the magazine 6, or the feed lever can be mounted to yield laterally, as is known.

Magazine 6 with cartridges 6a is provided with notches 6c into which the gripper 25b engages. With the notches provided along both edges of the magazine, it can be inserted by either of its opposite ends into the gun.

While specific embodiments of the invention have been shown and described in detail to illustrate the application of the inventive principles, it will be understood that the invention may be embodied otherwise without departing from such principles.

I claim:

1. An explosive powder driven setting gun for driving fastening elements having a pointed end and an oppositely directed head end, such as nails and the like, into a hard receiving material, including a gun housing, an axially extending barrel mounted in said housing, said barrel having a muzzle end from which the fastening elements are driven into the receiving material and a rearward end, and a feeding device for supplying fastening elements into the barrel, said feeding device being pivotally mounted on said housing, wherein the improvement comprises that said feeding device is pivotally displaceable between a first position for inserting fastening elements into the feeding device and a second position for inserting fastening elements from the feeding device through the muzzle end of the barrel into the barrel, said feeding device including a tubular member having an open end through which fastening elements can be inserted into the tubular member and displaced from the tubular member, and an ejector in said tubular member for displacing a fastening element from the tubular member into the barrel.

2. An explosive powder driven setting gun as set forth in claim 1, wherein said ejector comprises a plunger movably displaceably mounted within said tubular member.

3. An explosive powder driven setting gun as set forth in claim 2, wherein holding means being provided within said tubular member for holding a fastening element therein and preventing a fastening element from falling out when the feeding device is pivoted from the first position to the second position.

4. An explosive powder driven setting gun, as set forth in claim 3, wherein said holding means is a magnet.

5. An explosive powder driven setting gun, as set forth in claim 4, wherein said magnet being incorporated into said plunger.

6. An explosive powder driven setting gun, as set forth in claim 2, wherein said plunger having a front end directed toward the open end of said tubular member and the front end of said plunger having a recessed centering seat for receiving the pointed end of the fastening element.

7. An explosive powder driven setting gun, as set forth in claim 1, wherein holding means being positioned within said barrel for holding the fastening element inserted from said feeding device.

8. An explosive powder driven setting gun, as set forth in claim 7, wherein said holding means comprises a spring member secured within said barrel and extending into the path of the fastening element inserted into the barrel.

9. An explosive powder driven setting gun, as set forth in claim 1, wherein said barrel is axially displaceably mounted in said housing and is movable between a firing position and a second position in which the setting gun cannot be fired, means mounted on said housing and connected to said feed device for preventing said barrel from moving into the firing position while said feeding device is located in the second position in front of the muzzle end of said barrel.

10. An explosive powder driven setting gun, as set forth in claim 9, wherein said means for preventing said barrel from moving comprises a gripping arm movably mounted on said housing and connected to said feed device and displaceable by said feed device into position for blocking said barrel from moving into the firing position.

11. An explosive powder driven setting gun, as set forth in claim 10, wherein said barrel having a shoulder thereon, said gripping arm arranged to engage said shoulder for preventing the barrel from moving into the firing position.

12. An explosive powder driven setting gun, as set forth in claim 10, including a feed lever pivotally connected to said housing, means interconnecting said gripping arm and said feed lever for pivotally displacing said feed lever in response to the movement of said gripping arm when said feed device is moved between the first and second positions, said housing having a passage therethrough rearwardly of the rearward end of said barrel for receiving a cartridge magazine.

13. An explosive powder driven setting gun, as set forth in claim 12, wherein said feed lever comprising a swivel arm pivotally connected at one end of said housing, said swivel arm having a cam slot intermediate the ends thereof, a pin connected to said gripping arm and fitted into the cam slot in said swivel arm, and an engaging member on the other end of said swivel arm for engagement with the magazine for advancing the magazine in a step-wise manner.

14. An explosive powder driven setting gun, as set forth in claim 1, wherein said feeding device being pivotally displaceable through approximately 180° between the first position and the second position so that in the first position said tubular member of said feeding device is disposed in laterally spaced and substantially parallel relation with the axis of said barrel and in the second position the axis of said tubular member being co-axial with the axis of said barrel.

* * * * *